United States Patent [19]

Webber

[11] 4,370,765

[45] Feb. 1, 1983

[54] ENVELOPE FOR A BED HAVING SIDE RAILS

[76] Inventor: Gloria C. Webber, 44 Gail Dr., New Rochelle, N.Y. 10805

[21] Appl. No.: 184,646

[22] Filed: Sep. 5, 1980

[51] Int. Cl.[3] ..... A47C 21/08; A47G 9/00

[52] U.S. Cl. ..... 5/427; 5/482

[58] Field of Search ..... 5/482, 425, 428; 297/219, 218

[56] References Cited

U.S. PATENT DOCUMENTS

| | | | |
|---|---|---|---|
| 3,504,941 | 4/1970 | Gerard | 297/219 |
| 3,742,530 | 7/1973 | Clark | 5/425 |
| 4,232,898 | 11/1980 | Bodrero | 297/219 |

FOREIGN PATENT DOCUMENTS

| | | | |
|---|---|---|---|
| 160052 | 3/1921 | United Kingdom | 5/427 |
| 174850 | 2/1922 | United Kingdom | 297/219 |

*Primary Examiner*—Alexander Grosz

*Attorney, Agent, or Firm*—Paul R. Audet

[57] ABSTRACT

An envelope for a bed with side rails, comprised of an enveloping portion for enveloping the side rails, and a flap positionable between a mattress and mattress support and securable to the latter, to maintain the mattress in bed alignment and close off any gap between a side rail and the mattress or mattress support, and thereby prevent injury to a bed occupant.

5 Claims, 5 Drawing Figures

ENVELOPE FOR A BED HAVING SIDE RAILS

BACKGROUND OF THE INVENTION

This invention relates to beds having side rails. More particularly, the invention is directed to a device for preventing injuries from occurring to bed occupants mainly because they or their appendages become lodged in a space or gap which exists or is created between the bed's fixed or movable side rails and the bed mattress, or mattress support.

Hospitals, nursing homes, institutions and like patient care establishments utilize beds which typically have vertically movable side rails to prevent patients from falling out of beds, and to facilitate, for example, cleaning, removing and replacing bed sheets, mattresses and patients. When the movable side rails are raised and set in their normal working position, the lowermost side rails of even the best beds are in a horizontal position at or just above the upper plane of the mattress. In those instances where the lowermost side rail is above the plane of the mattress, even when the mattress is properly aligned, a hazardous space or gap exists between the mattress and lowermost side rail. Misalignment of the mattress increases the gap. When the lowermost side rail is at or below the upper plane of an aligned mattress, a hazardous gap is created by mattress misalignment or by downward patient pressure on the mattress edge.

It is too well known that because of these bed constructions and spaces or gaps, whether or not due to askew mattresses, bed occupants or patients who are asleep, or cannot control or do not realize the significance of their movements, particularly the elderly, physically handicapped, mentally ill, restless or confused, often injure themselves when their bodies, arms, legs or chests become lodged between the bed side rails, or more commonly between a bed side rail and the bed, mattress or mattress support. Such patients needlessly suffer pressure marks, bruises, dislocated, fractured or broken bones, or still worse, their heads and/or necks become lodged, they lose conciousness and all too often, they thereafter live in a permanent state of vegetation.

A successful but often cruel and otherwise unnecessary means of preventing such injuries has been the use of straight jackets and other appendage restraint means which are fastened to the bed.

A recently devised, more humane means for preventing these injuries is a mattress sling disclosed in copending U.S. Application Ser. No. 021,913 now U.S. Pat. No. 4,232,415. While this device has been successfully employed, there is a need for an improved device which is more economical and is easier to install, use and remove.

It is a main object of this invention to provide such an improved device for preventing the above-described and other injuries from occurring.

Another object of this invention is to provide a device for stabilizing and maintaining a mattress in proper position on a bed having side rails so that a bed occupant is prevented from being exposed to a dangerous gap or space between lower bed side rails, and the bed, mattress, or mattress support.

Another object is to meet the above objectives with a device which provides a bed occupant with freedom of movement, ventilation and visibility.

Still another object is to meet the above objectives with a device which is inexpensive to construct and maintain, and, in relation to a bed and its side rails, is easy to install, use and remove.

DETAILED DESCRIPTION OF THE DRAWINGS

Figure 1:
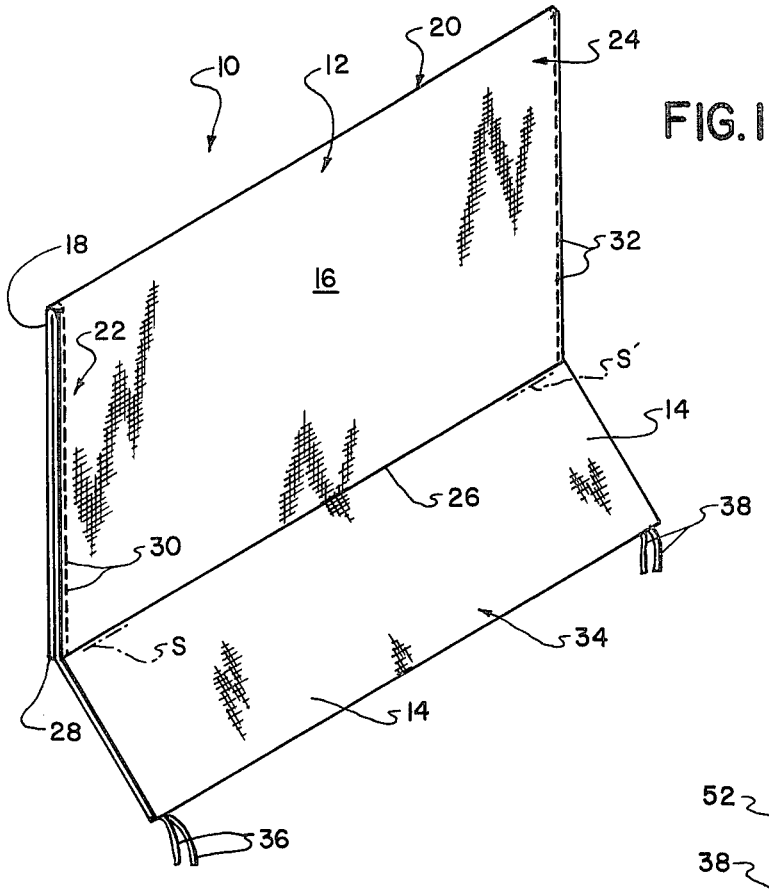
FIG. 1 is a perspective view of a preferred embodiment of the envelope of this invention.

Referring to the drawings in detail, FIG. 1 shows a preferred embodiment of the envelope of this invention, generally designated 10, adapted for use with a bed having a mattress support and one or more substantially horizontal side rails vertically spaced or removed from the upper plane of a mattress placed on the mattress support. Envelope 10 is open and is comprised of an enveloping portion 12, adapted to fit over one or more of the vertically spaced side rails, and a flap 14 extending from the enveloping portion, and adapted to be positioned under a mattress between the mattress and mattress support. More particularly, enveloping portion 12 has an inner sheet 16, an outer sheet 18, top and side edge portions respectively designated 20, 22 and 24, and inner and outer sheet bottom edges respectively designated 26, 28 which define between them envelope opening O (see FIG. 3). The inner and outer sheets are closed along their corresponding respective top and side edge portions. In the preferred embodiment shown, enveloping portion 12 is a continuous sheet of meshed or netting material which is folded in half and has its respective juxtaposed side edge portions attached or secured together by suitable means such as stitching 30, 32. Depending from inner sheet 16, preferably as a continuation thereof along what for purposes of explanation is a fold line defining inner sheet bottom edge 26, is flap 14 having means, for example pairs of ties 36, 38 attached thereto preferably at positions along its remote edge portion 34, more preferably, at least near the corners of the flap for securing or attaching the flap to a mattress support in a manner that prevents the mattress from shifting out of its proper position thereon, and prevents the bed occupant or his or her appendage from becoming lodged between two side rails and/or between the lowermost of the one or more vertically spaced side rails and the mattress or mattress support. Envelope 10 can be provided with slits represented by dotted lines S′ near the longitudinal head and foot ends of flap 14, for example, as shown adjacent and along inner sheet bottom edge 26 at or along the junction of or the fold line between inner sheet 16 and flap 14, for passing patient care apparatus therethrough.

Figure 3:
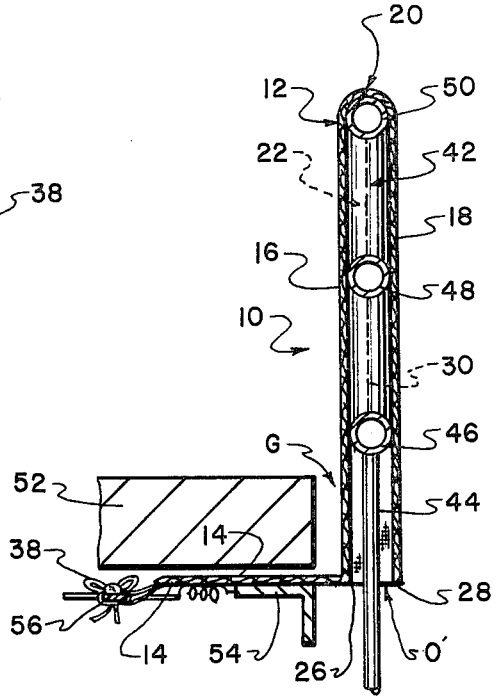
FIG. 3 is an enlarged fragmentary cross sectional view with portions broken away, taken substantially along line 3—3 of FIG. 2.
Figure 2:
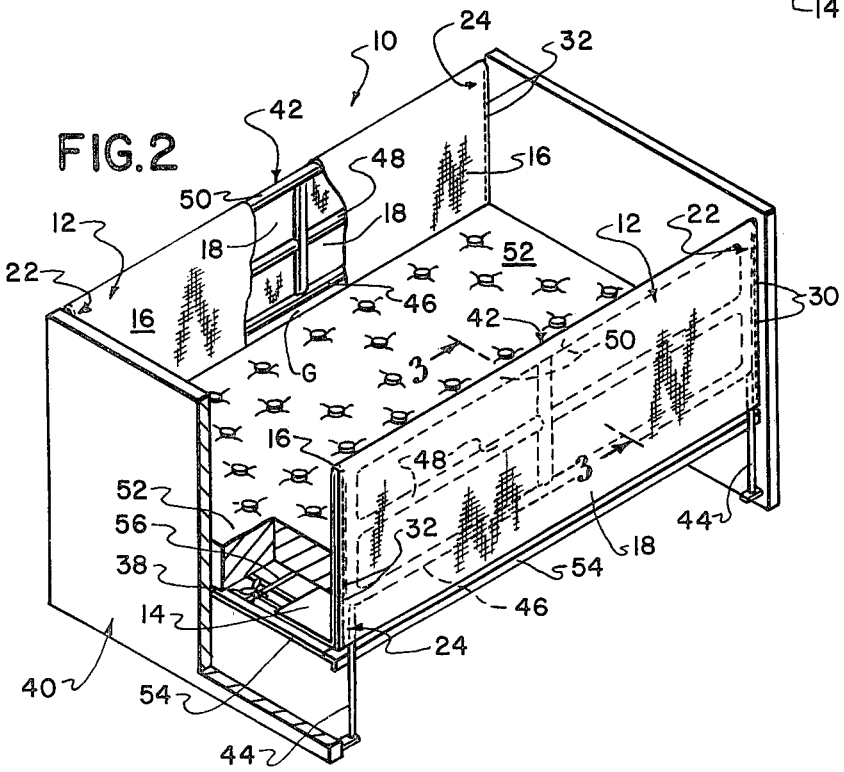
FIG. 2 is a perspective view with portions broken away and portions partially in section, showing the envelope of FIG. 1 in use on the side rails of a conventional hospital bed.

FIG. 2 is a perspective view showing envelope 10 of FIG. 1 in working position on a bed generally designated 40, which is typical of beds commonly used in hospitals, nursing homes and institutions. Bed 40 has side rail units 42, which, by means of their sleeves (not shown) vertically reciprocate on posts 44. Each side rail unit 42 has one or more substantially horizontal side rails, here, 46, 48, 50, the lowermost of which is usually alongside or as shown in FIG. 3, inches above the upper plane of mattress 52. Any space of gap G between mattress 52 and lowermost side rail 46 or between the side rail and mattress support, here shown as a spring frame 54, whether due to the construction of the bed or to an askew mattress, would allow the possibility of lodgement of the bed occupant or his or her appendage between side rail 46 and mattress 52 or spring frame 54. A possibility of lodgement also would exist due to the gaps between respective side rails 46, 48, and 50. As also shown in FIG. 3, a cross section taken substantially along line 3—3 of FIG. 2, such possibilities of lodgement are prevented by the envelope of this invention whose enveloping portion 12 is positioned on and fits over or substantially envelopes one of the bed's side rail units 42, and whose flap 14 is positioned such that it extends under the adjacent longitudinal lower side edge of mattress 52 between the mattress and mattress support, and is secured or tied, preferably, by ties 36 (FIG. 3) and 38 to a portion of a spring or elongated band 56 which for purposes of explanation, is considered part of spring frame 54. If the mattress support does not have springs or bands, each pair of ties 36 and 38 can be made long enough to extend down to and be tied to mattress support spring frame 54 preferably at the head and foot ends of bed 40. FIGS. 2 and 3 show that inner sheet 16 of each envelope extends substantially tautly both along substantially the length of mattress 52 and substantially upward from adjacent the side of the mattress to a vertically upwardly removed side rail, here, uppermost side rail 50. Since enveloping portion 12 and its inner and outer sheets 16, 18 are preferably formed of one continuous piece, inner sheet 16 becomes outer sheet 18 along the fold line of the enveloping portion top edge 20, and outer sheet 18 extends tautly downward beyond one or more, here, all of side rails 46, 48 and 50 such that its bottom edge 28 is juxtaposed relative to bottom edge 26 of inner sheet 16. The vertical length of sheet 18 or the extent to which outer sheet 18 depends, need only be that length or extent which will assure that the envelope will stay on the side rail despite whatever forces a patient may exert on the sheets. Although not shown, if necessary, outer sheet 18 may be secured to inner sheet 16 by securing means attached to either or both sheets in relative positions suitable for effective securement thereof below one of the side rails. Side edge portions 22, 24, closed by stitching 30, 32, just beyond the head and foot ends of the side rail units, provide horizontal tautness to enveloping portion 12 and prevent longitudinal movement or slippage of the envelope and enveloping portion relative to the side rail units. Closed side edge portions 22, 24, aided by ties 36, 38 tied to a portion of the mattress support maintain envelope 10, and mattress 52 in proper position and alignment relative to bed 40, mattress support spring frame 54, side rail units 42 and its side rails, particularly lowermost side rail 46.

FIG. 3 shows envelope 10 in working position holding mattress 52 in proper longitudinally aligned position. It shows enveloping portion 12 fitting tautly over and substantially enveloping side rail unit 42, inner sheet 16 extending tautly from adjacent the mattress bottom, up along the insides of the side rails to uppermost side rail 50, and flap 14 tied to a portion of mattress support spring frame 54 and extending tautly under mattress 52 to provide a one-piece, continuous barrier which effectively blocks or seals off any dangerous gap between the side rails, or between the side rails and mattress or mattress support.

Figure 4:
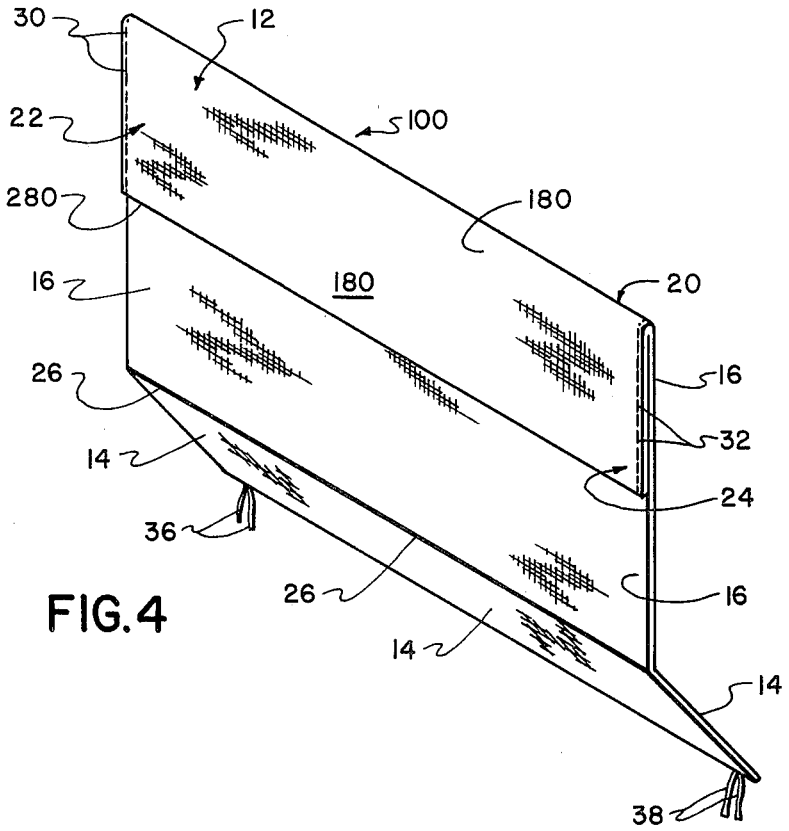
FIG. 4 is a perspective view of another embodiment of the envelope of this invention.

FIG. 4 is a perspective view showing another embodiment of the envelope of this invention. More particularly, it shows an envelope, generally designated 100, similar in all respects to the envelope of FIG. 1, except that its outer sheet, here, 180, depends a vertical distance or length which is less than that of inner sheet 16, such that outer sheet bottom edge 280 extends downwardly to or just below side rail 48.

Figure 5:
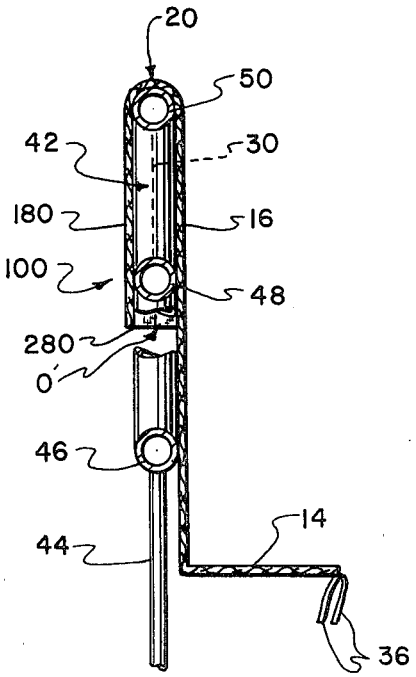
FIG. 5 is an enlarged fragmentary sectional view similar to FIG. 3, as would be taken through the envelope of FIG. 4 were it covering the side rails of a bed.

FIG. 5 is an enlarged vertical cross sectional view somewhat similar to that which might be taken through envelope 100 of FIG. 4, were it placed on side rail unit 42 on the left side of the bed shown in FIG. 2. FIGS. 4 and 5 show that the outer sheet of the envelope of this invention need not be of full vertical length but need only depend enough to substantially envelope one or more side rails. The more agitated the bed occupant, the lower the outer sheet should depend, although it need only depend enough relative to the uppermost side rail that, given the occupant, it causes inner sheet 18 to be in an effective, sufficiently secure position. For very agitated bed patients, it may be desirable to secure a less than full length outer sheet to the inner sheet below one of the side rails by suitably placed cooperative snaps, belts, tapes, or strips of hooks and loops sold under the trade designation "Velcro". FIG. 5 shows that the opening O′ for envelope 100 is defined by edge 280 and an adjacent portion of inner sheet 16.

The envelope of this invention can be placed in working position by slipping enveloping portion 12 over and thereby enveloping one or more of the bed side rails, lifting the edge of the mattress, tying ties 36, 38 to a portion of the mattress support, and dropping the mattress onto flap 14. As an alternative method for beds having vertically movable side rail units, the side rail unit can be moved to its downwardly displaced position, flap 14 can be secured to the mattress support, and the side rail moved upward and locked in its working raised position, as shown in FIGS. 2, 3 and 5. Once the envelope is in position, a bed occupant can be placed on the mattress and patient care apparatus such as a catheter drainage tube, or straps of a straight jacket or of a wrist or ankle restraint can be passed through slits S′ and secured to the patient.

Envelope 10 can be made of any suitable material or materials. Preferably and most simply, it can be made of one continuous sheet or piece of material wherein the inner and outer sheets and flap 14 are integral and made of one piece of meshed, netted or screen-like material, for example such as may be used for playpens. In a less preferred embodiment, the inner and outer sheets and flap can be made of more than one piece. The inner sheet and flap can be integral with the inner sheet secured to the outer sheet along closed top edge portion 20, or the sheets and flap can each be different pieces of the same or different materials secured, for example, sewn respectively together along top edge portion 20 and/or inner sheet bottom edge 26. Flap 14 could for example be made of a washable cotton sheet or canvas material. Basically, the flap refers to that portion of the envelope which underlies a portion of the mattress and/or overlies the mattress support to an extent sufficient to meet the objectives of this invention. Inner and outer sheets 16, 18 whether integral or made of a plurality of pieces secured together, preferably are made of a material capable of preventing a human appendage from passing therethrough under conditions encounterable in the bed environment. The material should allow air and light passage therethrough to permit proper bed occupant ventilation and observation. Desirably, the side sheets are made of a meshed or net-like plastic or polymeric material, such as nylon, and which is strong, durable and washable, and not coarse or abrasive to the bed occupant's skin. The mesh of the material should be tight to prevent fingers from being caught therein.

For reinforcement, stitching 30 and 32 along the inner and outer sheet side edge portions 22, 24 and the stitching along inner sheet bottom edge 20, can be made through one or more backing members such as a continuous strip or cloth or canvas material.

It is thought that the invention and many of its attendant advantages will be understood from the foregoing description, and it is apparent that various changes may be made in the form, construction and arrangement of parts without departing from the spirit and scope of the invention or sacrificing all of its material advantages, the articles herein before described being merely preferred embodiments thereof.

I claim:

1. An envelope sized and adapted for use with a bed having a mattress support and one or more substantially horizontal side rails vertically spaced from the upper plane of a mattress when placed on a mattress support, comprising an enveloping portion and a flap extending freely therefrom, the enveloping portion having a closed top and side portions and being adapted to fit over and envelop one or more of the vertically spaced side rails, and the flap being adapted to extend under the adjacent longitudinal lower side edge of a mattress, and having means for securing the flap to a mattress support in a manner that prevents a mattress from shifting out of its proper position on a mattress support, and prevents a bed occupant or his or her appendage from becoming lodged between two side rails and/or between the lowermost of the one or more vertically spaced side rails and the mattress or mattress support.

2. An envelope sized and adapted for use with a bed having a mattress support and one or more substantially horizontal side rails vertically spaced from the upper plane of a mattress when placed on a mattress support, comprising an enveloping portion and a flap, the enveloping portion having inner and outer sheets closed along their corresponding respective top and side edge portions, said enveloping portion having an opening defined by the bottom edges of said inner and outer sheets, and said flap extending freely from a bottom edge portion of one of said sheets, said enveloping portion being adapted to fit over and envelop one or more of the vertically spaced side rails, and the flap being adapted to extend under the adjacent longitudinal lower side edge of a mattress and having means for securing the flap to a mattress support in a manner that prevents a mattress placed on a mattress support from shifting out of its proper position thereon, and prevents a bed occupant or his or her appendage from becoming lodged between two side rails and/or between the lowermost of the one or more vertically spaced side rails and a mattress or mattress support.

3. The envelope of claim 1 or 2 wherein the enveloping portion is a continuous sheet folded along its length to form inner and outer sheets whose respective side edges are secured together.

4. The envelope of claim 1 or 2 wherein the enveloping portion is made of a meshed material which allows air and light to pass therethrough yet prevents a human appendage from passing therethrough.

5. The envelope of claim 4 wherein the flap is made of a meshed material.

* * * * *